United States Patent [19]

Quenneville et al.

[11] Patent Number: 4,793,307

[45] Date of Patent: Dec. 27, 1988

[54] ROCKER ARM DECOUPLER FOR TWO-CYCLE ENGINE RETARDER

[75] Inventors: Raymond N. Quenneville, Suffield; Vincent J. Pitzi, South Windsor, both of Conn.

[73] Assignee: The Jacobs Manufacturing Company, Bloomfield, Conn.

[21] Appl. No.: 133,488

[22] Filed: Dec. 15, 1987

Related U.S. Application Data

[63] Continuation-in-part of Ser. No. 60,505, Jun. 4, 1987, abandoned.

[51] Int. Cl.[4] ..... F02D 9/06

[52] U.S. Cl. ..... 123/323; 123/90.16; 123/90.12; 123/90.41

[58] Field of Search ..... 123/90.13, 90.12, 90.15, 123/90.16, 90.39, 90.41, 321, 323, 347

[56] References Cited

U.S. PATENT DOCUMENTS

| | | | |
|---|---|---|---|
| 3,220,392 | 11/1965 | Cummins | 123/90.12 X |
| 4,399,787 | 8/1983 | Cavanagh | 123/90.16 X |
| 4,473,047 | 9/1984 | Jakuba et al. | 123/323 |
| 4,485,780 | 12/1984 | Price et al. | 123/321 |
| 4,503,818 | 3/1985 | Hara et al. | 123/90.16 |
| 4,572,114 | 2/1986 | Sickler | 123/321 X |
| 4,592,319 | 6/1986 | Meistrick | 123/321 |
| 4,612,887 | 9/1986 | Yoshizaki | 123/90.39 X |
| 4,648,362 | 3/1987 | Kastlunger | 123/90.16 X |

*Primary Examiner*—Michael Koczo
*Assistant Examiner*—Peggy A. Neils
*Attorney, Agent, or Firm*—Donald E. Degling

[57] ABSTRACT

The invention is applicable to an internal combustion engine of the four-stroke cycle type equipped with a compression release engine retarder capable of producing one compression release event and one bleeder retarding event in each cylinder during every two revolutions of the engine crankshaft. This is accomplished by a novel articulated rocker arm assembly including a rocker member and a latch member in which the rocker member, engaged by the exhaust pushtube, is disengaged from the latch member, which acts against the crosshead, after a compression release event has occurred, but remains engaged if a compression release event does not occur. When the latch member is disengaged from the rocker member, the exhaust valves are held in a partially open position to produce a bleeder retarding event. A trigger valve acutated by the exhaust pushtube and rocker member vents the reatarder high pressure hydraulic system to initiate the bleeder retarding event.

31 Claims, 7 Drawing Sheets

TDC
COMP
TDC
POWER
EXHAUST
NORMAL EXHAUST
VALVE MOTION
TDC
INTAKE
VALVE MOTION
DISABLED
EXHAUST VALVE
MOTION DURING
RETARDING
10
12
14
15
16
18
20
21
12
0
180
360
540
540
CRANK ANGLE

ROCKER ARM DECOUPLER FOR TWO-CYCLE ENGINE RETARDER

BACKGROUND OF THE INVENTION

This application is a continuation-in-part of application Ser. No. 060505 filed June 4, 1987 now abandoned.

1. Field of the Invention

This invention relates generally to an improved mechanism for an engine retarder of the compression release type. More particularly, the invention relates to a rocker arm decoupling mechanism for use in a four-stroke cycle engine equipped with a two-stroke cycle engine retarder wherein the decoupling mechanism disables the normal exhaust valve opening.

2. Prior Art

Since the 1950's, the problem of providing adequate and reliable braking for large trucks and tractor trailers has been recognized and a number of auxiliary or supplemental braking systems have been developed. Such systems include hydraulic or electrodynamic systems in which the kinetic energy of the vehicles is transformed by fluid shear or magnetic eddy currents into heat which is dissipated through heat exchangers. Other mechanisms include exhaust brakes wherein the flow of exhaust gas is inhibited and compression release retarders wherein the engine is temporarily converted into an air compressor.

A principal advantage of the compression release engine retarder over the hydraulic and electrodynamic retarders is that both of these latter types of retarders require dynamos or turbine equipment which may be both bulky and expensive compared with the mechanism required for the compression release retarder.

The original compression release retarders were designed for four-stroke cycle engines, usually of the compression ignition type, wherein the air compressed during the compression stroke was released by opening the exhaust valve near the end of the compression stroke. In this way, the energy required to compress the air was dissipated through the engine exhaust and cooling systems and was not recovered, in part, during the ensuing expansion stroke. Of course, the fuel supply was interrupted or, at least, substantially restricted, so that no power was developed when the engine was operating in the retarding mode. A typical compression release engine retarder is shown in the Cummins U.S. Pat. No. 3,220,392. A form of an engine retarder that incorporates certain of the characteristics of the compression release retarder and those of the exhaust brake is known as the bleeder brake. In this mechanism, the exhaust or intake valves (or both) are maintained in a partially open position during the braking mode so that the engine consumes energy due to pumping of the air through the partially open valves. Bleeder brakes are disclosed in the Siegler U.S. Pat. No. 3,547,087 and Jonsson U.S. Pat. No. 3,367,312. Other forms of compression release retarders are disclosed in Cartledge U.S. Pat. No. 3,809,033; Pelizzoni et al. U.S. Pat. No. 3,786,792 and Dreisen U.S. Pat. No. 3,859,970.

Since the issuance of the Cummins U.S. Pat. No. 3,220,392, improvements have been made in various aspects of the mechanism while maintaining the same mode of operation, i.e., one compression release event for every complete engine cycle which comprises two crankshaft revolutions. Such improvements include: a mechanism to prevent excess motion of the slave piston (Laas U.S. Pat. No. 3,405,699); a mechanism to prevent excess pushtube loading (Sickler U.S. Pat. No. 4,271,796); mechanisms to advance the opening of the exhaust valve during retarder operation (Custer U.S. Pat. No. 4,398,510; Price et al. U.S. Pat. No. 4,485,780); a mechanism to open only one of the dual exhaust valves during retarder operation (Jakuba et al. U.S. Pat. No. 4,473,047); and mechanisms to close the exhaust valve promptly after the compression release event (Cavanagh U.S. Pat. No. 4,399,787; Mayne et al. U.S. Pat. No. 4,423,712).

In response to increased fuel costs and more stringent requirements with respect to air pollution, engine operating speeds have been decreased and the engine tuning specifications modified. Both of these changes adversely affect the performance of the compression release engine retarder and tend to cancel out the effect of some of the improvements referred to above. Since each compression release event has become less effective, the art has now turned toward methods of increasing the number of compression release events per unit of time. Sickler U.S. Pat. No. 4,572,114 discloses a method and apparatus for engine retarding in which two compression release events are produced during each two revolutions of the engine crankshaft. Sickler, in effect, converts an engine which operates in a four-stroke cycle during the lowering mode into an air compressor which operates in a two-stroke cycle during the retarding mode. This necessitates disabling the exhaust and intake valves from opening at the time required for the powering mode and modifying the motion of the valves so that, for example, the intake valves open during the expansion (down) stroke of the piston while both the exhaust and intake valves are closed during the compression (up) stroke of the piston. Near the end of the compression (up) stroke, the exhaust valve is opened briefly to provide the compression release event.

Meistrick U.S. Pat. No. 4,592,319 discloses a process and apparatus for a compression release engine retarder which, in one form, produces one compression release event, one bleeder event and one intake valve opening per engine cycle. Another form of the invention produces two compression release events and one intake valve opening per engine cycle. U.S. Pat. No. 4,592,319 discloses both mechanical and hydromechanical mechanisms designed to disable the exhaust and intake valves from moving at the time normally required during a powering mode of operation.

During the powering mode of engine operation the exhaust valve is normally at least partially open when the intake valve begins to open and thus the intake valve is not required to open against any substantial cylinder pressure. If, for some reason, the exhaust valve does not open for either a normal exhaust or a compression release event, the pressure in the cylinder may be substantially higher than intended at the time when the intake valve is scheduled to begin to open. Under these circumstances, the intake valve train may be subjected to excessive loads which could, for example, cause permanent deformation of the pushtube. The present invention is directed to an automatic mechanism which assures that the cylinder pressure will be low whenever the valve train mechanism seeks to open the intake valves.

SUMMARY OF THE INVENTION

In accordance with the present invention, an internal combustion engine of the four-stroke cycle type is equipped with a compression release engine retarder capable of producing one compression release event and one bleeder retarding event during every two revolutions of the engine crankshaft. An articulated rocker arm assembly is provided in which the end of the rocker arm engaged by the pushtube may be disconnected from the end of the rocker arm which acts against the exhaust crosshead or exhaust valve. When the two portions of the rocker arm are engaged the exhaust valve is opened as in the normal powering mode of engine operation. However, when the two portions of the rocker arm are disconnected, the exhaust valve is prevented from closing completely so that, in either condition, subsequent opening of the intake valve occurs against low cylinder pressure. Trigger valve means actuated by motion of the exhaust pushtube are provided to vent the slave cylinder at a predetermined time and initiate the bleeder retarding event.

DESCRIPTION OF THE DRAWINGS

Further objects and advantages of the invention will become apparent from the following detailed description of the invention and the accompanying drawings in which.

DETAILED DESCRIPTION OF THE INVENTION

The present invention is intended to be employed with an internal combustion engine having a normal four-stroke cycle where the four strokes are an intake stroke, a compression stroke, a power or expansion stroke and an exhaust stroke. Preferably, the engine will be of the compression ignition type. In such engines, the valves and fuel injectors are commonly driven through a valve train comprising rotating cams which activate pushtubes or pushrods which, in turn, oscillate rocker arms. If the engine is equipped with dual valves, the rocker arm actuates a crosshead which, in turn, opens the valves. The compression release retarder mechanism preferably is driven from the fuel injector pushtube for the cylinder which is associated with the exhaust valve or valves actuated by the retarder mechanism. Alteratively, the compression release retarder mechanism may be driven from an exhaust pushtube or pushrod associated with a cylinder other than the cylinder in which the compression release event occurs.

Figure 1:
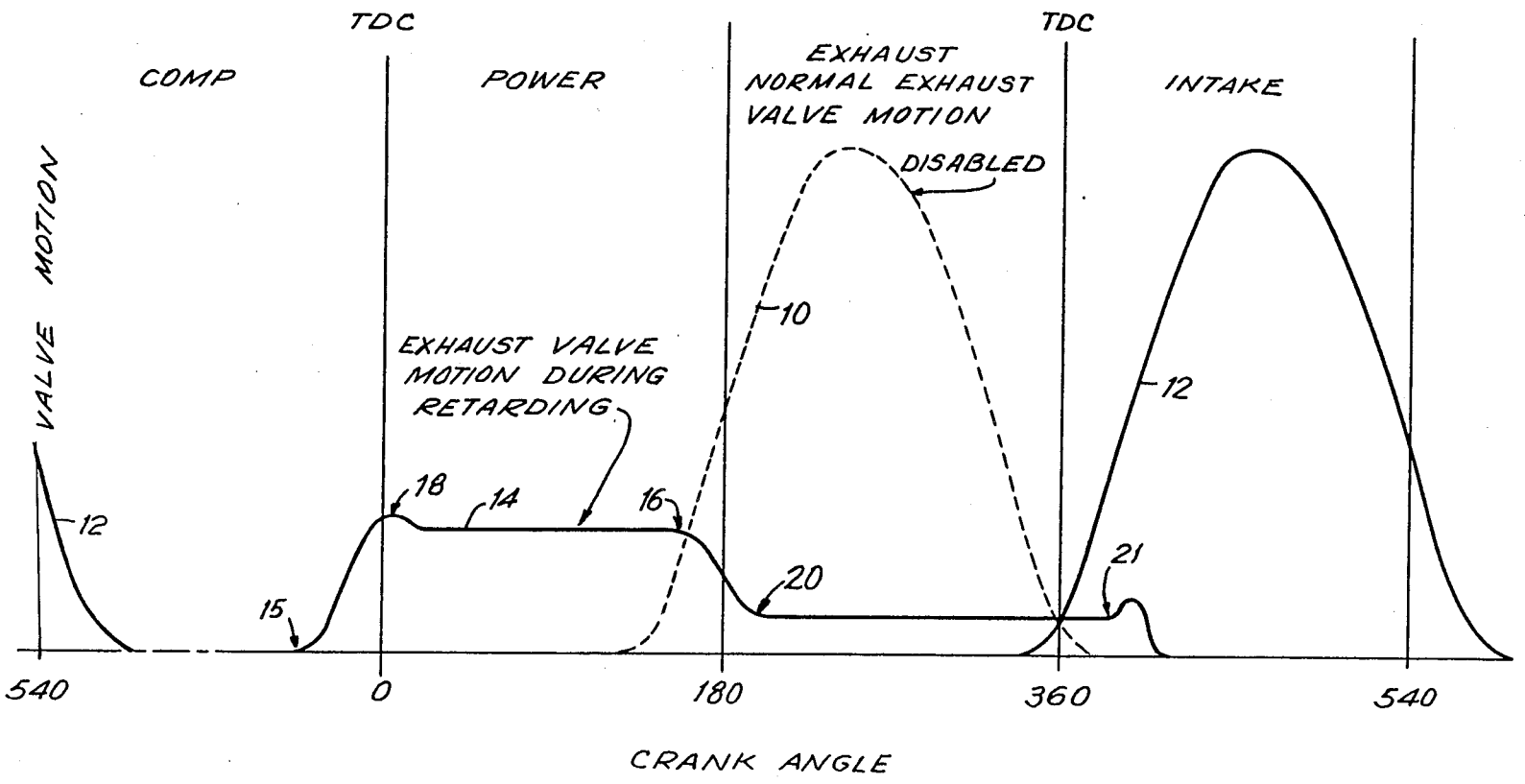
FIG. 1 is a diagram showing the motion of the exhaust and intake valves during a complete engine cycle under retarding conditions in accordance with the present invention so as to produce one compression release event and one bleeder event wherein the retarding mechanism is driven by the fuel injector pushtube.

Reference is now made to FIG. 1 which is a diagram of exhaust and intake valve motion over a complete engine cycle during retarding in accordance with the present invention. Curve 10, shown as a dashed line, represents the normal motion of the exhaust valve during the powering mode of engine operation. In accordance with the present invention, the exhaust rocker arm is decoupled from the crosshead during retarding so that this motion does not occur. Curve 12 represents the motion of the intake valve and is the same for both the powering and the retarding modes of engine operation. It may be noted from FIG. 1 that the beginning of the intake valve motion overlaps the end of the normal exhaust valve motion. Thus, during the normal powering mode of engine operation, the intake valve is never required to open against any substantial cylinder pressure.

Curve 14 represents the motion of the exhaust valve during the retarding mode of engine operation. The initial portion of curve 14 from shortly before TDC ( top dead center) (point 15) to about BDC (bottom dead center) (point 16) resembles the fuel injector motion curve (not shown) since it is derived from the motion of the fuel injector pushtube. A compression release event occurs between points 15 and 18. At point 16, a trigger valve mechanism described below vents the slave cylinder thereby allowing the slave piston, crosshead and exhaust valve to begin to close. At point 20, when the exhaust valve has attained the desired opening for a bleeder event, the exhaust valve rocker arm restrains the crosshead until the exhaust valve pushtube has almost returned to its rest position. As noted above, curve 12 represents the normal intake valve action which provides a fresh charge of air for the ensuing compression release event.

Figures 2, 2A:
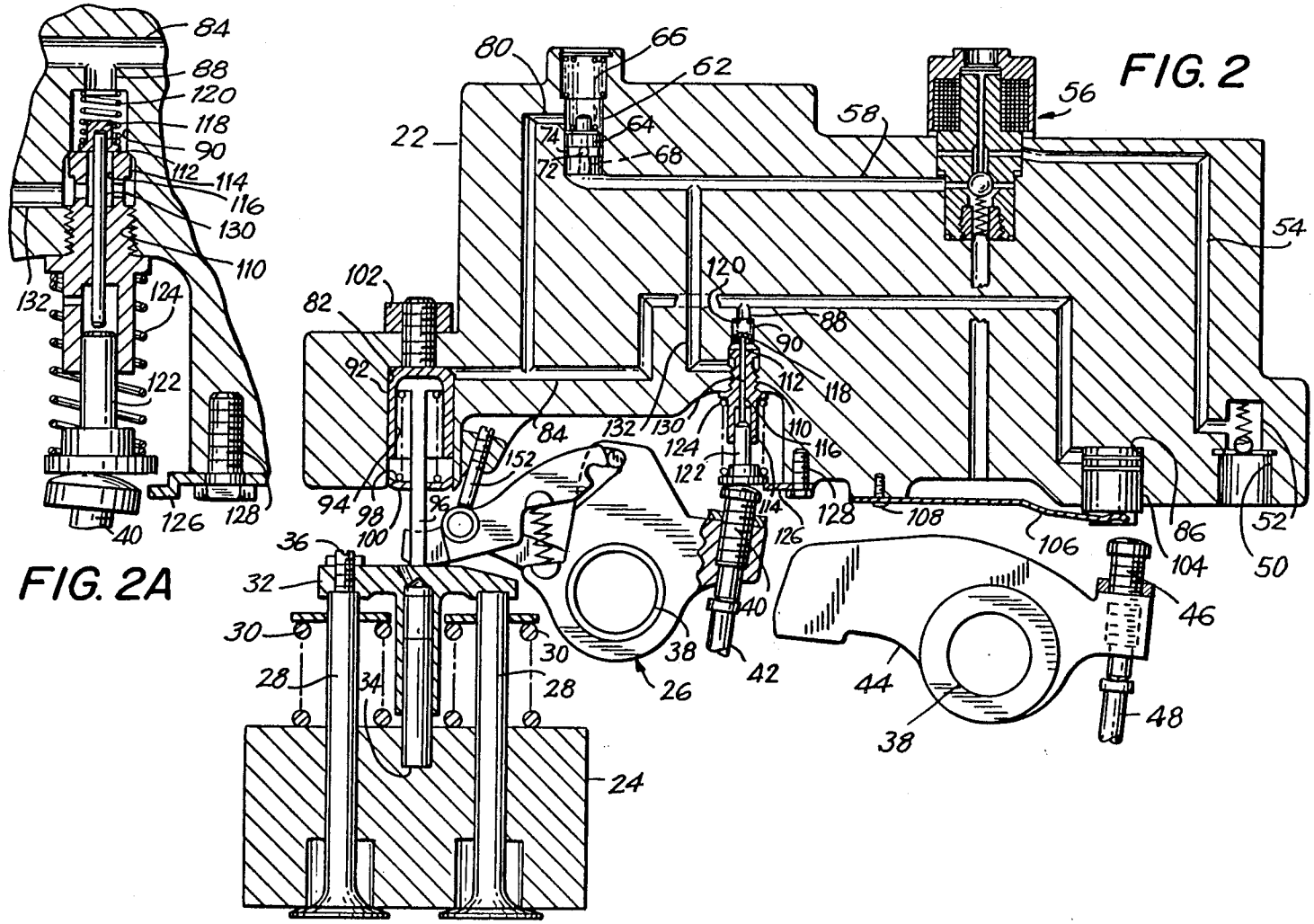
FIG. 2 is a schematic drawing illustrating the mechanical, hydraulic and electrical circuits in accordance with the present invention which produce the valve motions illustrated in FIG. 1.
FIG. 2A is a fragmentary enlarged sectional view of the trigger valve mechanism shown in FIG. 2.

Reference is now made to FIG. 2 which illustrates, schematically, the mechanisms used to practice the present invention. Housing 22 may be affixed to the engine cylinder head 24 so as to lie above the rocker arm assembly, including exhaust valve rocker arm assembly 26. Dual exhaust valves 28 are mounted for reciprocating motion within the cylinder head 24 and are biased toward the closed position by the usual valve springs 30. The exhaust valves 28 are driven by a crosshead 32 mounted for reciprocating motion on pin 34 affixed to the cylinder head 24.

The crosshead 32 is provided with at least one adjusting screw mechanism 36 whereby the dual exhaust valves 28 can be adjusted to open simultaneously. The rocker arm assemblies including exhaust rocker arm assembly 26 are journalled for oscillatory motion on the rocker arm shaft 38 which, in turn, is carried by the usual supports (not shown) affixed to the engine cylinder head 24. Rocker arm assembly 26 includes an adjusting screw 40 driven from its lower end by exhaust pushtube 42.

A fuel injector rocker arm 44 is journalled for oscillatory motion on the rocker arm shaft 38 and is provided with an adjusting screw 46 driven by fuel injector pushtube 48.

The hydro-mechanical engine retarding mechanism includes a duct 50 communicating with the low pressure engine lubricating oil system (not shown), a check valve 52 oriented to prevent flow of oil back to the engine lubricating oil system and duct 54 communicating with the inlet of a three-way two-position solenoid valve 56. When the solenoid valve 56 is opened, i.e., actuated, oil flows through the check valve 52, duct 54, solenoid valve 56 and into duct 58.

Duct 58 communicates with control cylinder 62 within which control piston 64 reciprocates. Control piston 64 is biased in a downward direction (as viewed in FIG. 2) by a compression spring 66. The control piston 64 contains an axial bore 68 which communicates with a diametral bore 72. An annular groove 74 formed on the outer surface on the control piston 64 communicates with the diametral bore 72. A ball check valve (not shown) is biased against one end of the bore 68 so as to permit flow through the control valve from duct 58.

In its uppermost position the annular groove 74 of the control piston 64 registers with a duct 80 which communicates with the slave cylinder 82 and also with duct 84 which, in turn, communicates with the master cylinder 86. A branch 88 of the duct 84 communicates with trigger valve cavity 90.

A slave piston 92 is mounted for reciprocating motion within the slave cylinder 82 and carries, in an internal bore 94, an actuator 96 which seats on one end against the slave piston 92 and on the other end against the top of the crosshead 32. A compression spring 98 seats in a bracket 100 affixed to the housing 22 and biases the actuator 96 and the slave piston 92 in an upward direction (as viewed in FIG. 2) against a slave piston adjusting screw 102 threaded into housing 22.

A master piston 104 is mounted for reciprocating motion in the master cylinder 86 and biased in an upward direction (as shown in FIG. 2) by a leaf spring 106, one end of which is affixed to the housing 22 by a screw 108. The lower end of the master piston 104 is adapted to be driven through the adjusting screw 46 of the fuel injector rocker arm 44 by the fuel injector pushtube 48.

A trigger valve chamber 110 is formed in the housing 22 and communicates with the trigger valve cavity 90 (see FIG. 2A). A trigger valve body 114 containing a trigger valve seat 112 is threaded into the trigger valve chamber 110. A passageway 116 is formed axially through the trigger valve body 114. Trigger valve 118 is biased toward the valve seat 112 by a compression spring 120 located within the trigger valve cavity 90. A trigger valve driver 122 is mounted for reciprocating motion with respect to the trigger valve body 114. The trigger valve driver 122 is biased in a downward direction (as shown in FIGS. 2 and 2A) by a compression spring 124 so as to seat against adjusting screw 40. A stop 126 fastened to the housing 22 by a screw 128 is provided for ease in assembling the mechanism. A pin 130 which, if desired, may be integral with the driver 122, is closely fitted for reciprocating motion in the axial passageway 116 formed in the body 114 and communicates between the driver 122 and the trigger valve 118. A duct 132 communicates between duct 58 and trigger valve cavity 90 via the trigger body 114 and valve seat 112, when the valve 118 is open.

Figures 3, 4:
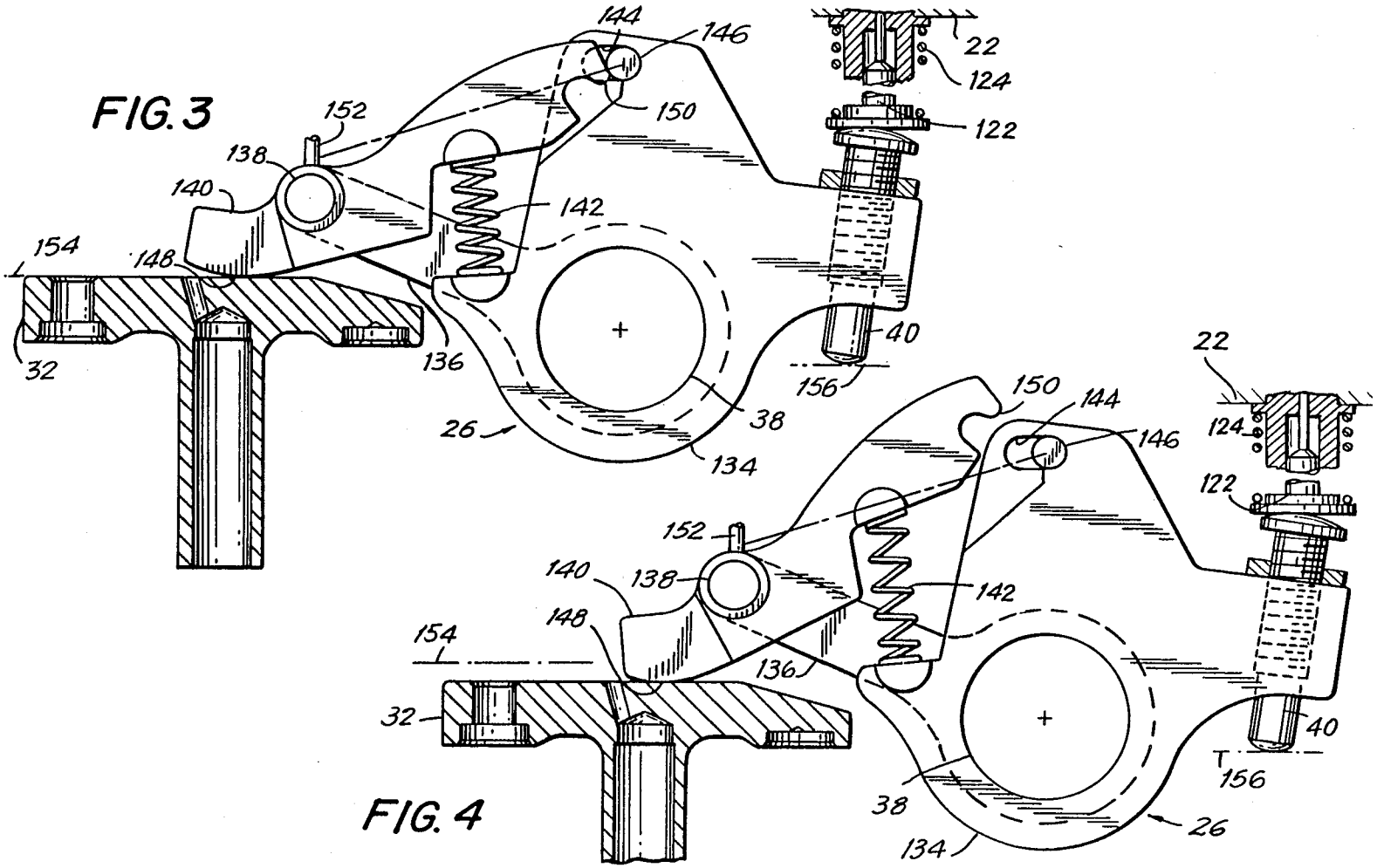
FIG. 3 is a detail of the rocker arm and crosshead mechanism, partly in section, adjusted for the normal powering mode of the engine.
FIG. 4 is a detail of the rocker arm and crosshead mechanism, partly in section, as it appears during the compression release event when the engine is in the retarding mode of operation.

Referring now to FIG. 3, the exhaust valve rocker arm assembly 26 comprises a rocker member 134 journalled on the rocker arm shaft 38. The adjusting screw mechanism 40 is threaded into the rocker member 134. A pair of links 136 are also journalled at one end on the rocker arm shaft 38 and carry a pin 138 at the opposite end. A latch member 140 is journalled on the pin 138 and biased away from the rocker member 134 by a compression spring 142. Guideways 144 are formed in the rocker member 134 within which a latch pin 146 is free to move.

The latch member 140 is provided with a face area 148 at one end adapted to contact the crosshead 32 and a hook 150 at the other end adapted to engage the latch pin 146. An adjustable stop 152 is mounted on the housing 22 to limit the clockwise rotation of the links 136 with respect to the rocker arm shaft 38.

Figure 6:
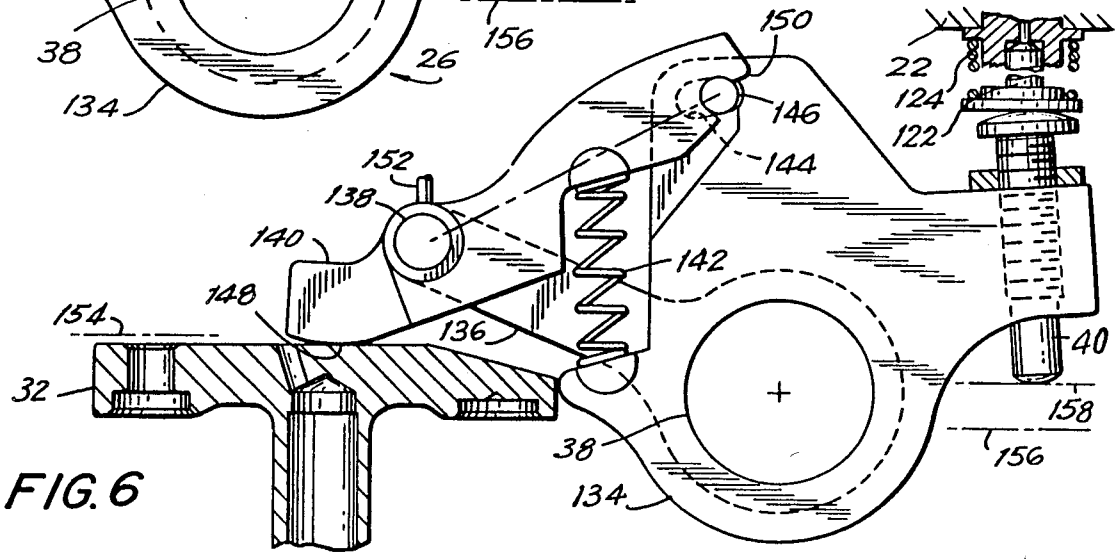
FIG. 6 is a detail of the rocker arm and crosshead mechanism, partly in section, as it appears when the exhaust pushtube is fully extended while the engine is in the retarding mode of operation.

FIG. 3 illustrates the rocker arm assembly 26 and the crosshead 32 adjusted for the normal powering mode of operation with the exhaust valves closed and the crosshead 32 at the limit of its travel in the upward direction. This position is indicated by line 154 which is aligned with the top surface of the crosshead 32. The retracted position of the pushtube 42 (FIG. 2) is indicated by the line 156 while the extended position of the pushtube is indicated by line 158 (FIG. 6). It will be appreciated that when the pushtube 42 (FIG. 2) moves upwardly against the adjusting screw 40, the rocker member 134 will be oscillated in a counterclockwise direction about the rocker arm shaft 38 and the latch pin 146 will engage the end of the hook 150 on the latch 140. The face area 148 will therefore be driven downwardly (as shown in FIGS. 2 and 3) so as to drive the crosshead 32 in a downward direction and open the exhaust valves 28. It will be seen that in the normal powering mode, the rocker arm assembly functions as though it were a rigid body with no relative motion of the components thereof. Also, in the position shown in FIG. 3, pin 138 rests against the adjusting screw 152. It will be understood that the pin 138 moves away from the adjusting screw 152 when the exhaust valves are opened during the powering mode.

FIG. 4 illustrates the position of the rocker arm assembly 26 and the crosshead 32 during the retarding mode of operation when the slave piston 92 (FIG. 2) has driven the crosshead 32 downwardly so as to open the exhaust valves 28 to provide a compression release event. As the crosshead 32 moves downward, the compression spring 142 biases the latch member 140 so that it oscillates in a counterclockwise direction with respect to the pin 138 and the hook 150 moves away from the latch pin 146. This motion begins at point 15 and is maintained between points 18 and 16 of curve 14 as shown in FIG. 1.

Figure 5:
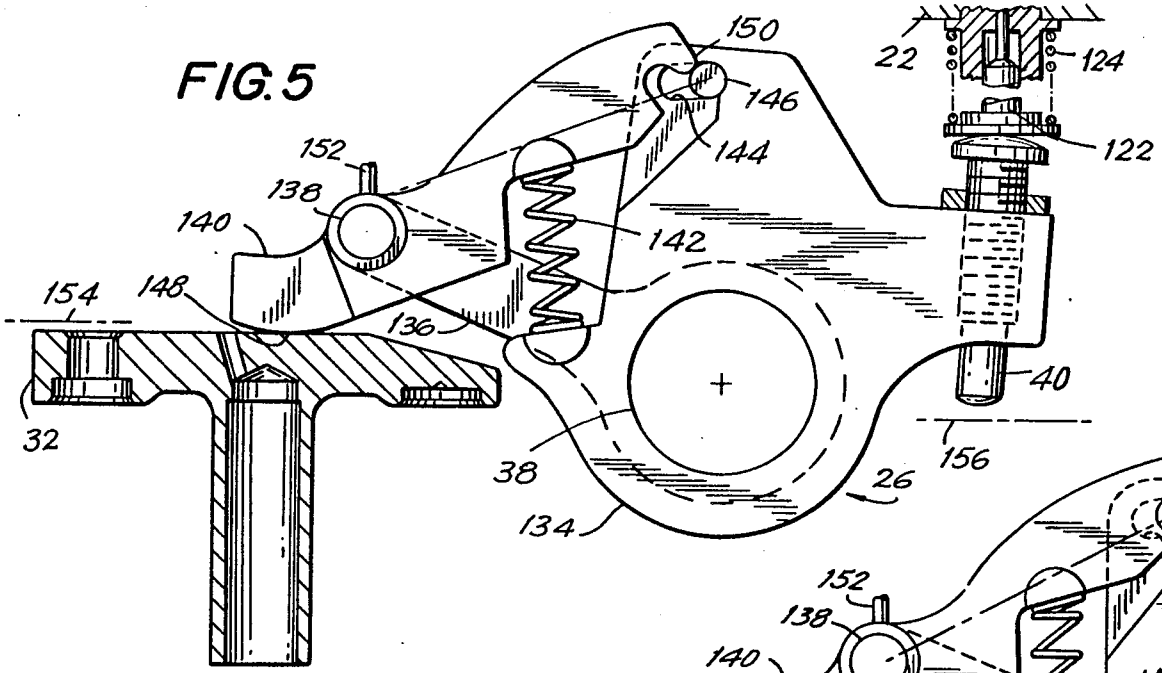
FIG. 5 is a detail of the rocker arm and crosshead mechanism, partly in section, as it appears at the beginning of the bleeder retarding event when the engine is in the retarding mode of operation.

The normal motion of the exhaust valve pushtube 42 is also shown by curve 10 in FIG. 1. As the pushtube 42 moves upwardly beginning at about 135° ATDC (after top dead center), the rocker member 134 will be oscillated in a counterclockwise direction. If the crosshead has been depressed to cause a compression release event as indicated in FIG. 4, the latch pin 146 engages the hook 150 as shown in FIG. 5 so as to prevent the crosshead 32 from returning all the way to its rest position.

Further motion of the exhaust pushtube 42 causes further oscillation of the rocker member 134 until the hook 150 fully engages the latch pin 146 as shown in FIG. 6. It will be noted, as shown in both FIGS. 5 and 6 that when the hook 150 contacts or engages the latch pin 146, the latch 140 is slightly displaced so as to maintain the crosshead 32 in a slightly depressed position thereby holding the exhaust valves open to a predetermined extent. FIG. 6 illustrates the position of the rocker arm assembly at a crank position of about 250° ATDC where the exhaust pushtube has moved to its extreme upward or extended position.

The exhaust pushtube 42 retracts as the crankshaft moves from about 250° ATDC to shortly after the ensuing top dead center position of the crankshaft. Initially, as the pushtube 42 retracts, the latch pin 146 rides along the guideways 144 as the spring 124 biases the rocker member 134 in a clockwise direction (as shown in FIG. 6.. The force due to spring 124 is insufficient to overcome the force of the valve springs 30 and the force generated by the cylinder pressure so that the hook 150 of the latch member 140 remains engaged with the latch pin 146. This causes the adjusting screw 40 to separate slightly from the pushtube 42. However, after the crankshaft passes the top dead center position the force due to the cylinder pressure decreases to such a extent that the force of the spring 124 drives the latch pin 146 over the hook 150 and permits the exhaust valves 28 to close. This occurs at point 21 (FIG. 1). The mechanism thus returns to the condition illustrated in FIG. 3 in preparation for the next compression release event or for return to the powering mode of engine operation.

The operation of the mechanism described above will now be described. When the solenoid valve 56 is actuated, low pressure engine oil flows through the check valve 52, duct 54, solenoid valve 56 and duct 58 into the control valve cylinder 62 and thereby lifts the control valve 64 against the bias of spring 66 until the annular groove 74 registers with duct 80. The check valve in the control valve 64 then opens and allows oil to flow through duct 80 into the slave cylinder 82, and through ducts 84 and 88 into the master cylinder 86 and the trigger valve cavity 90. The low pressure oil will take up the mechanical clearances in the mechanism but the force applied to the slave piston 92 is insufficient to cause any movement of the crosshead 32 or the exhaust valves 28.

Just before 0° crank position, the injector pushtube 48 moves in an upward direction (as shown in FIG. 2) and causes the adjusting screw mechanism 46 to drive master piston 104 in an upward direction so as to pump hydraulic fluid through duct 84 into 15 the slave cylinder 82. As the slave piston 92 moves downwardly, carrying with it the actuator 96, the lower end of the actuator 96 drives the crosshead 32 downwardly to open the exhaust valves 28. This produces a compression release event at about TDC and near the end of the compression stroke of the engine. The exhaust valves will remain open during most of the expansion stroke since the injector remains seated during the expansion and exhaust strokes. This permits air to reenter the engine cylinder from the exhaust manifold when the cylinder pressure drops to or below the pressure existing in the exhaust manifold. Thus, at the end of the expansion stroke, the cylinder will be filled with air at about atmospheric pressure.

At about the 160° ATDC crank position, the exhaust pushtube 42 will begin its upward travel. At this time, the rocker arm assembly 26 will be in the position illustrated in FIG. 4 and described above. Continued motion of the exhaust pushtube 42 causes the adjusting screw mechanism 40 to contact the trigger driver 122 so as to drive the pin 130 upwardly to engage the trigger valve 118. At a predetermined time which is a function of the length of the pin 130, the trigger valve 118 is opened and the high pressure hydraulic fluid in the slave cylinder 82 and ducts 84 and 88 is vented through the trigger valve body 114 and duct 130 to the low pressure duct 58 and the control valve cylinder 62. The excess hydraulic fluid is stored in the control valve cylinder 62 under the control valve 64.

As the hydraulic pressure in the slave cylinder 82 drops, the slave piston 92 begins to retract and is followed by the crosshead 32 and exhaust valves 28. However, the exhaust rocker assembly 26 is now in a position intermediate that shown in FIGS. 5 and 6 so that as the exhaust valves 28 begin to close, the crosshead 32 drives the latch member 140 in a clockwise direction about pin 138 until the hook 150 strikes the latch pin 146. When the rocker arm assembly reaches the position shown in FIG. 6, the exhaust valves cease to close and are held open to a predetermined extent.

As shown in FIG. 1, the closing motion of the exhaust valves occurs at about BDC so that during the ensuing exhaust stroke the charge of air contained in the engine cylinder is throttled through the exhaust valves to produce a bleeder retarding event. It will be seen that the exhaust valves 28 are open, at least partially, when the intake valves are required to begin to open shortly before the 360° crank position.

Figure 7A:
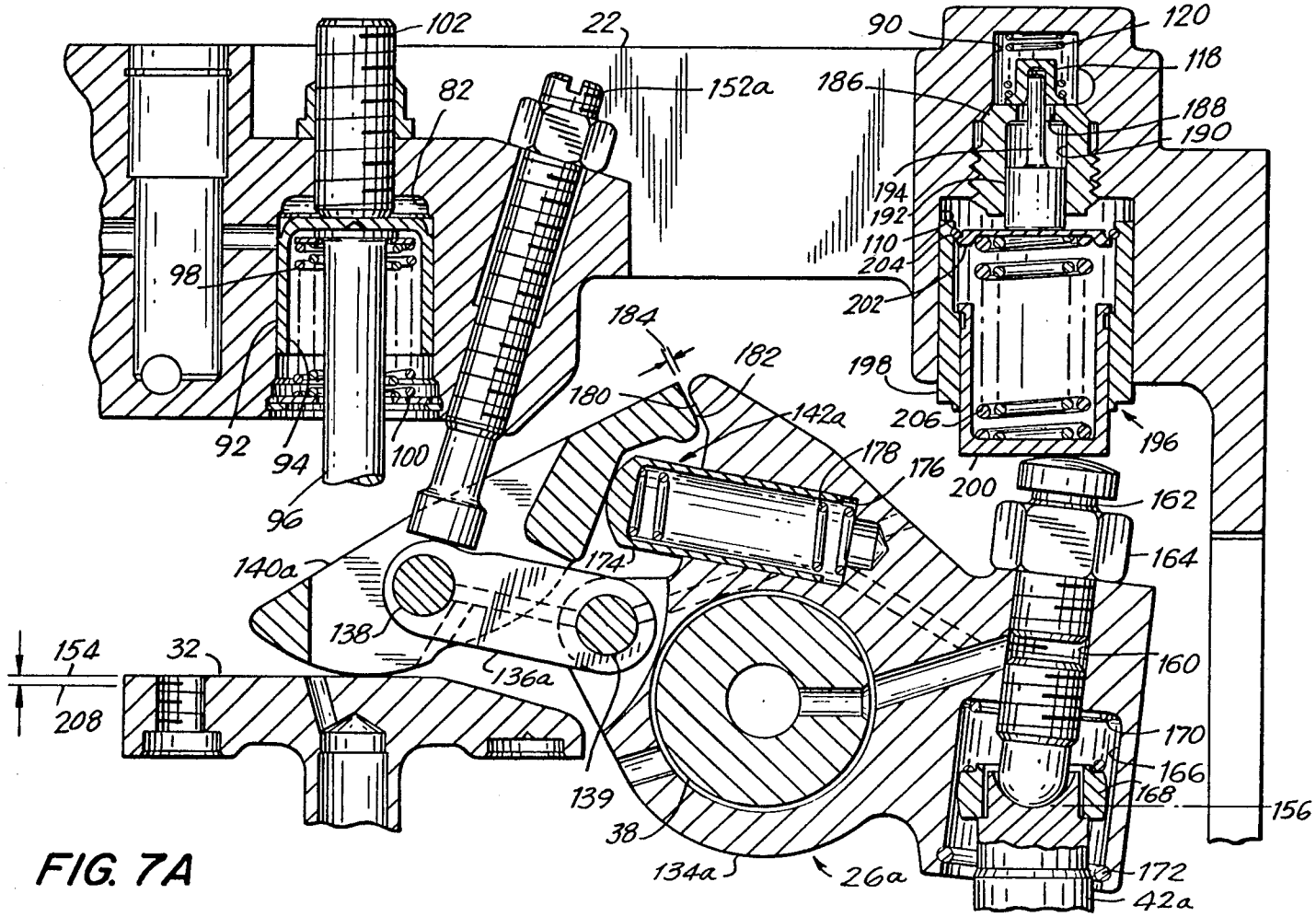
FIG. 7A is a detail of a modified rocker arm and crosshead mechanism, partly in section, adjusted for the normal powering mode of the engine.

A modified form of the rocker arm and crosshead assembly is shown in FIG. 7A. Parts which are identical with those illustrated in FIGS. 2 through 6 bear the same designators and their description will not be repeated here. The modified rocker arm assembly **26*a* comprises a rocker member 134*a* mounted for oscillating movement on the rocker shaft 38. A threaded bore 160 is provided in the rocker member 134*a* to accommodate an adjusting screw 162 and a lock nut 164. The adjusting screw 162 extends into an enlarged bore 166 formed in the rocker member 134*a* to contact the upper end of the pushtube 42*a* which is modified from the form shown in FIG. 2 by the addition of a collar 168 having an outer diameter slightly smaller than the diameter of the bore 166. A compression spring 170 is seated in the end of the enlarged bore 166 so as to bias the collar 168 and pushtube 42*a* downwardly toward the engine cam shaft (not shown). A snap ring or O-ring 172 is seated in a groove near the open end of the enlarged bore 166 to retain the upper end of the pushtube 42*a* within the enlarged bore 166**. It will be appreciated that the modification of the pushtube and rocker arm connection eliminates the possibility that the pushtube may become displaced during operation of the engine in the retarding mode.

The modified rocker arm assembly **26*a* also includes a latch member 140*a*, a link 136*a* interconnecting the latch member 140*a* and the rocker member 134*a* and biasing means 142*a* acting between the rocker member 134*a* and the latch member 140*a*. The link 136*a* is connected at one end to the latch member 140a through a pin 138 and at the other end to the rocker member 134a by a pin 139. If desired, the pins 138 and 139 may be integral with the latch member 140a, rocker member 134a or link member 136a so as to provide a pivotal mounting of the link member 136a with respect to the latch member 140a and rocker member 134a. The biasing means 142a comprises a piston 174 mounted for reciprocatory motion in a bore 176 formed in the rocker member 134a and biased toward the latch member 140a by a compression spring 178 seated in the bore 176. An adjustable stop 152a is threaded into the housing 22 and limits the motion of the end of the link 136a which carries pin 138. When the mechanism is in the engine powering mode condition as shown in FIG. 7A and the pushtube 42a is in its rest position as shown by line 156 and the crosshead 32 is in its uppermost position as shown by line 154, lip 180 of the rocker member 134a is spaced from the end 182 of the latch member 140a by a distance 184 which represents the lash in the valve train mechanism. Upward motion of the pushtube 42a will cause the rocker member 134a to rotate in a counterclockwise direction, compress the spring 178 and contact the end 182 of the latch member 140a. Further upward motion of the pushtube 42a will cause the rocker arm assembly 26a to rotate as a rigid body so that the face of the latch member 140a will drive the crosshead 32** downwardly to open the exhaust valves.

FIG. 7A also illustrates a modified trigger valve assembly structure which functions both as a trigger valve and a pushtube biasing means. The trigger valve assembly comprises a trigger valve seat 186 threaded into the trigger valve cavity 90. The trigger valve seat 186 is provided with an axial opening 188 which communicates with a bore 190. A piston 192 is closely fitted for reciprocatory motion in the bore 190 and is provided, on its upper end, with an actuating pin 194. A trigger valve 118 is positioned within the trigger valve cavity 90 and biased toward the valve seat 186 by a compression spring 120. A telescoping piston assembly 196 is located in the trigger valve chamber 110 and comprises an outer tubular member 198 and an inner piston member 200. The upper end of the tubular member 198 is closed by a disk 202 secured by a snap ring 204. A relatively stiff compression spring 206 seated between the disk 202 and the inner end of the piston member 200 biases the piston assembly 196 toward its extended position.

The trigger valve cavity 90 communicates with the high pressure duct 84 leading to the master cylinder 86 and the slave cylinder 82 through duct 88 (FIG. 2) while the bore 190 of the valve seat 186 communicates with the low pressure duct 58 leading to the control cylinder 62 through duct 132 (FIG. 2).

In operation, upward motion of the pushtube 42a is transmitted through the adjusting screw 162 and the telescoping piston assembly 196 to the piston 192 and actuating pin 194 which lifts the valve 118 away from the valve seat 186 thereby permitting the hydraulic fluid to pass from the high pressure side of the system to the low pressure side of the system. It will be appreciated that at the time the actuator 194 opens the trigger valve 118 near bottom dead center (see point 16 on FIG. 1) the pressure in the hydraulic system is low so that the spring 206 will not be compressed but, instead, acts as a rigid body. When the trigger valve 118 opens, hydraulic fluid will be dumped from the higher pressure side of the system above the slave piston 92 so as to permit the slave piston 92 and the crosshead 32 to retract.

Figure 7B:
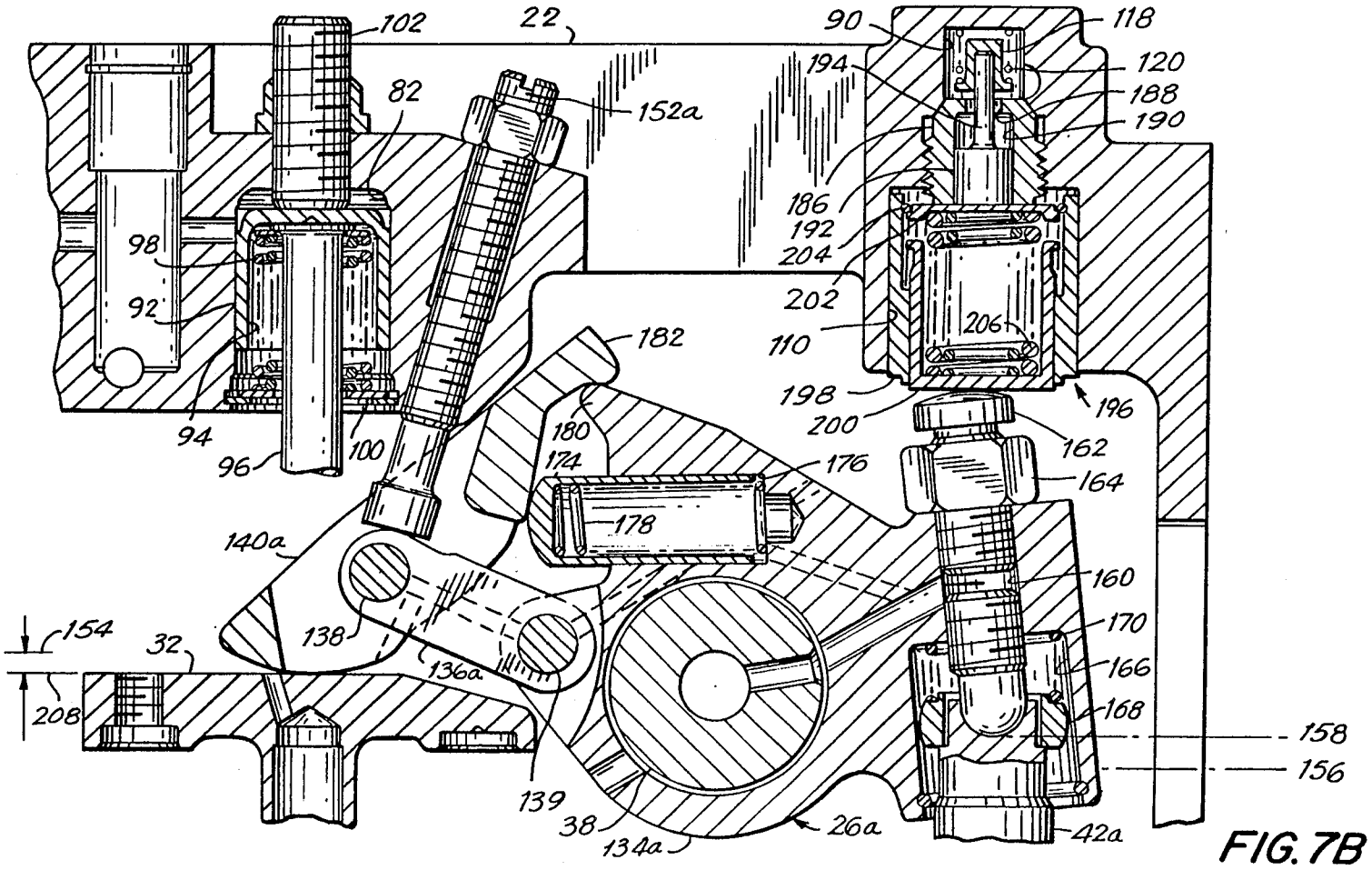
FIG. 7B is a detail of the modified rocker arm and crosshead mechanism of FIG. 7A, partly in section, when the exhaust pushtube is fully extended while the engine is in the retarding mode of operation.

Referring now to FIG. 7B, it will be seen that when the compression release event occurs near top dead center (FIG. 1), the slave piston 92 and the actuator 96 drive the crosshead 32 downwardly to open the exhaust valves. Compression spring 178 of the rocker assembly 16a drives the latch 140a in a counterclockwise direction about the pin 138 until the end 182 of the latch 140 clears the lip 180 of the rocker member 134a.

When the exhaust pushtube 42a begins to move upwardly shortly before the bottom dead center position of the crankshaft, the rocker arm member 134a rotates in a counterclockwise direction until the lip 180 moves under the end of the latch 140a. The upward motion of the pushtube 42a drives the telescoping mechanism 196 upwardly and opens the trigger valve 118. Opening of the trigger valve 118 releases the hydraulic fluid above the slave piston 92 an allows the crosshead to return to the position identified by line 208 on FIG. 7B. When the crosshead 32 is in the position indicated by line 208, the exhaust valves are maintained in a partially open position by the latching effect between the end of the latch 140a and the lip 180 of the rocker member 134a. As the pushtube 42a retracts it will separate from the adjusting screw 162 slightly but will be retained within the enlarged bore 166. Ultimately, the latching force due to the cylinder pressure and the valve springs 30 will be overcome by the unlatching force of springs 206 and 178 so that the rocker member 134a rotates in a clockwise direction to become free of the latch member 140a. This occurs at point 21 (FIG. 1). Thereafter, the exhaust valves 28 close. It will be seen that the mechanism of FIGS. 7A and 7B perform the same function as the mechanism of FIGS. 3 through 6 though the structure is slightly different.

Figure 8A:
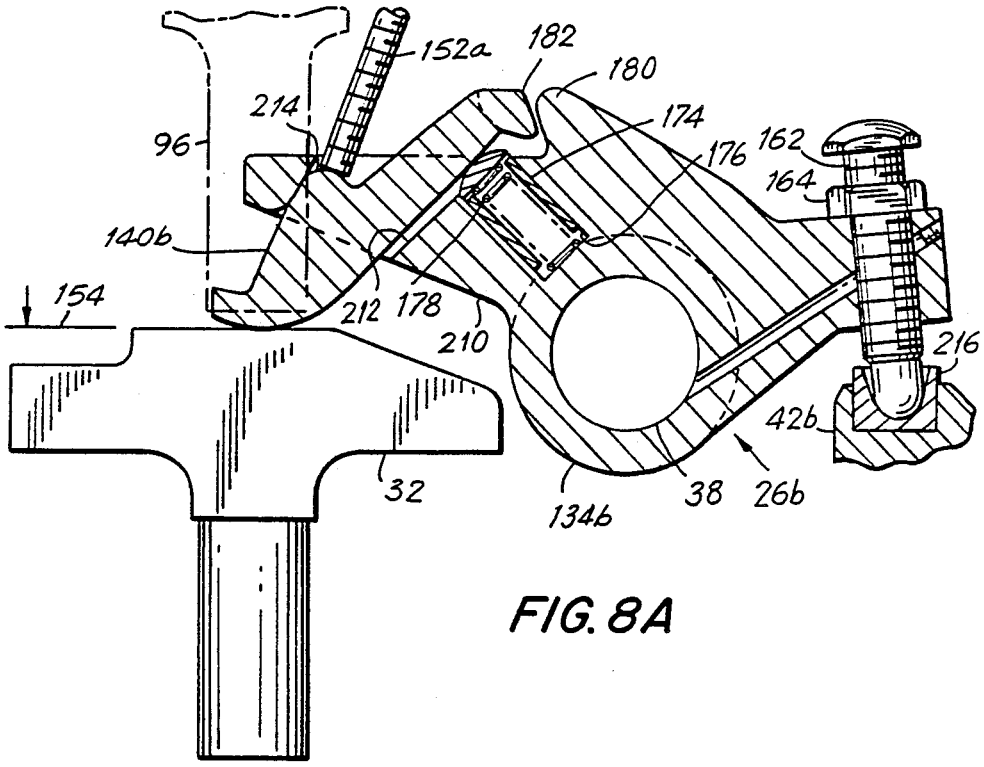
FIG. 8A is a detail of a further modified rocker arm and crosshead mechanism, partly in section, adjusted for the normal powering mode of the engine.
Figure 8B:
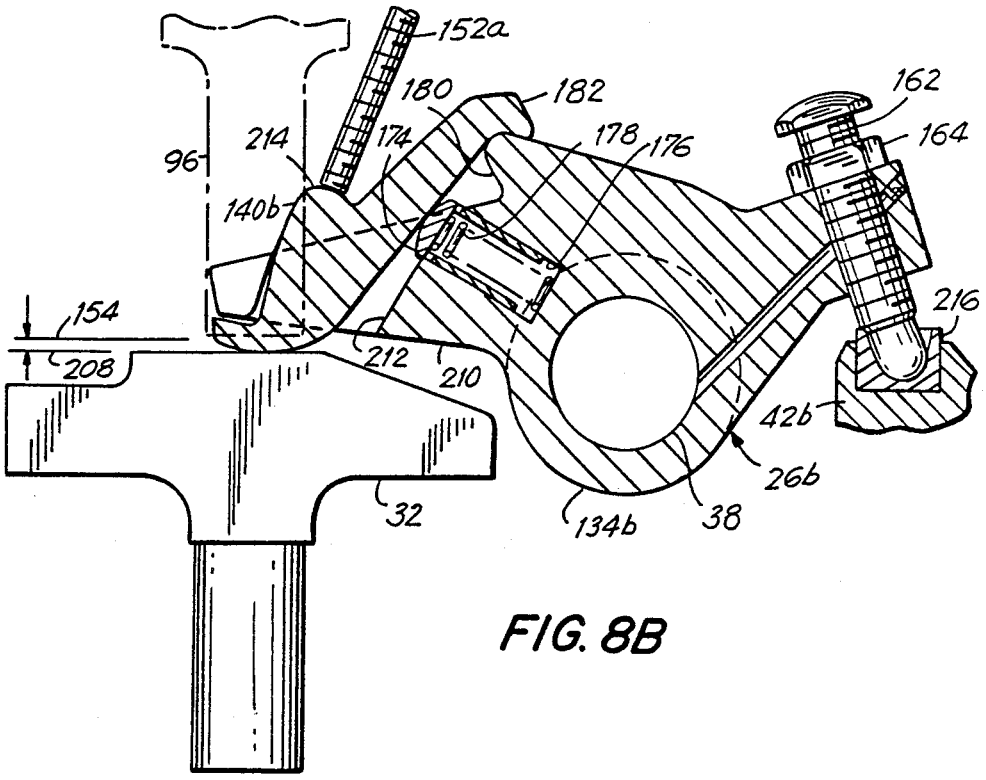
FIG. 8B is a detail of the further modified rocker arm and crosshead mechanism of FIG. 8A, partly in section, when the exhaust pushtube is fully extended while the engine is in the retarding mode of operation.

A still further modification of the rocker arm assembly is illustrated in FIGS. 8A and 8B which correspond to FIGS. 7A and 7B. Parts which are common to both constructions carry the same designator and will not be described again. For purposes of simplicity, the structure of the slave cylinder 82 and slave piston 92 and the trigger valve assembly 118, 196 have been omitted but it will be understood that the corresponding parts shown in FIGS. 2 and 2A or FIGS. 7A and 7B may be used interchangeably with the rocker arm assembly shown in FIGS. 8A and 8B.

Rocker member 134b is similar to rocker member 134a except that it is provided with a nose portion 210 having a hole 212 formed therethrough. The latch member 140b passes through the hole 212 and is formed with a lobe 214 which seats against the end of the adjusting screw 152a. The spring loaded piston 174 which is mounted in the rocker member 134b biases the latch member 140b in a counterclockwise direction so as to tend to disengage the end 182 of the latch member 140a from the lip 180 of the rocker member 134a.

The exhaust pushtube 42b is similar to the pushtube 42a (FIG. 7A) except that it is provided with a deep socket 216 on its upper end. It will be appreciated that the provision of the deep socket 216 permits the pushtube 42a to retract a substantial distance from the end of the adjusting screw 162 without disengaging therefrom. The deep socket 216 in FIGS. 8A and 8B thus performs the same function as the spring loaded collar 168 in the bore 166 shown in FIGS. 7A and 7B and may be used interchangeably therewith.

The operation of the mechanism shown in FIGS. 8A and 8B is as follows. FIG. 8A shows the rocker arm assembly 26b in the normal powering mode of operation at a time when the exhaust pushtube 42b is in its retracted position and the exhaust valves are closed so that the crosshead 32 is in its uppermost position as indicated by line 154. In this circumstance, the lip 180 of the rocker member 134b will be separated from the end 182 of the latch member 140b by a distance representing the clearance in the valve train mechanism. As the exhaust pushtube 42b moves upwardly towards its extended position, the rocker member 134b rotates in a counterclockwise direction until the clearance between the lip 180 of the rocker member 134b and the end 182 of the latch member 140b is taken up. Thereafter, the latch member 140b will be driven by the rocker member 134b so as to separate from the adjusting screw 152a and the face of the latch 140b will drive the crosshead 32 downwardly to open the exhaust valves. It will be seen that during the powering mode of operation, the rocker arm assembly 26b functions essentially as a rigid body.

In the retarding mode of operation, the assembly starts from the position illustrated in FIG. 8A but near the top dead center position of the crankshaft (0° crankangle) the slave piston actuator 96 drives the crosshead 32 downwardly to open the exhaust valves and initiate a compression release event. As the crosshead 32 moves downwardly, the spring biased piston 174 causes the latch member 140b to move so that the end 182 clears the lip 180 of the rocker member while the face end of the latch member 140b remains in contact with the crosshead 32.

Shortly before bottom dead center (180° crankangle), the exhaust pushtube 42b begins to move upwardly and drives the lip 180 of the rocker member 134b under the end 182 of the latch member 140b. At some point during the upward movement of the pushtube 42b, the trigger valve is actuated by the adjusting screw 162 and the force on the actuator 96 thereby released. The crosshead 32 then moves upwardly until it is restrained by the latch member 140b which seats against the stop 152a as shown in FIG. 8B. It will be seen that the partially open position of the crosshead is indicated by line 208 and may be adjusted by moving the adjusting screw 152a. The position shown in FIG. 8B is maintained between about 180 to about 360 crankangle degrees so as to produce a bleeder retarding event.

When the exhaust pushtube 42b again retracts, the pushtube 42b separates slightly from the adjusting screw 162 but the end of the adjusting screw 162 remains within the deep socket 216. As the cylinder pressure drops, the unlatching forces due to the trigger valve spring and the spring 178 ultimately overcome the locking forces due to the valve springs 30 and the cylinder pressure and the mechanism will return to the position shown in FIG. 8A. Unlatching occurs at point 21 (FIG. 1). The mechanism is now ready to perform either a powering function in which the exhaust valves are opened during the exhaust stroke or a retarding function.

As suggested above, any of the rocker arm constructions shown in FIGS. 3, 7 and 8 may be used with either of the trigger valve constructions shown in FIGS. 2 and 7 and either of the pushtube designs shown in FIGS. 7 and 8.

It will be appreciated that the mechanism provided by the present invention has a number of advantages and provides a retarding event in each cylinder during each crankshaft revolution. The mechanism is relatively simple and assures that the cylinder pressure will be low whenever the intake valves are required to open. Thus, the exhaust valve rocker arm assembly is disabled from opening the exhaust valves only after a compression release event occurs at about the 0° crank angle position. If, for any reason, the compression release event does not occur, the rocker arm assembly will remain locked in its powering mode so as to open the exhaust valves during the exhaust stroke of the engine piston.

The preceding description has been posited on the assumption that the compression release retarder was driven by the injector pushtube of the engine. However, if the engine is not provided with an injector pushtube or if, for some reason, it is not desired to use the injector pushtube motion, the compression release retarder may be driven from the exhaust pushtube for a cylinder other than the cylinder being retarded. Such an arrangement is disclosed, for example, in Jakuba et al. U.S. Pat. No. 4,473,047 which is incorporated by reference herein. To employ such an arrangement in the present invention it is necessary to relocate the master cylinder 86 so that it can be acted upon by an exhaust pushtube 42 instead of the injector pushtube 48. Since each exhaust pushtube 42 is required to actuate a trigger valve driver 122, a crosshead mechanism similar to crosshead 32 may be provided intermediate the adjusting screw mechanism 40 driven by the exhaust pushtube 42, on the one hand, and the trigger valve driver 122 and relocated master cylinder 86 and master piston 104, on the other hand.

It will be appreciated, as disclosed in Meistrick U.S. Pat. No. 4,592,319 which is incorporated by reference herein, that when the motion of an exhaust pushtube is used to drive a compression release retarder, the exhaust valves will close shortly after the compression release event occurs. If, as in the present invention, it is desired to maintain the valves open or partially open for an extended period so as to recharge the engine cylinder with air in preparation for a bleeder retarding event, additional means mutt be provided for this purpose. Such means are fully disclosed in U.S. Pat. No. 4,592,319 referred to above.

The terms and expressions which have been employed are used as terms of description and not of limitation and there is no intention in the use of such terms and expressions of excluding any equivalent of the features shown and described or portions thereof, but it is recognized that various modifications are possible within the scope of the invention claimed.

What is claimed is:

1. An engine retarding system of a gas compression release type comprising a multi-cylinder four-stroke cycle internal combustion engine having a crankshaft and a camshaft driven from said crankshaft, engine piston means associated with said crankshaft, exhaust valve means, intake valve means and fuel injector means associated with each cylinder of said engine, rocker arm means associated with each of said exhaust valve means, intake valve means and fuel injector means, pushtube means driven from said camshaft and associated with said exhaust valve means, intake valve means and fuel injector means, hydraulic fluid supply means, hydraulically actuated first piston means associated with said exhaust valve means to open said exhaust valve means, second piston means actuated by said pushtube means associated with said fuel injector means and hydraulically interconnected with said first piston means and said hydraulic fluid supply means to open said exhaust valve means during an upstroke of the engine piston associated with said exhaust valve means corresponding to its compression stroke during normal operation of the engine to produce a compression release event and to hold said exhaust valve means open during a substantial portion of the ensuing downstroke of said engine piston, said rocker arm means associated with said exhaust valves comprising a rocker member adapted to be oscillated by said exhaust valve pushtube, a latch member adapted to drive said exhaust valve means, link means interconnecting said rocker member and said latch member, adjusting screw means adapted to limit the oscillation of said link means and means biasing said latch member away from said rocker member, said exhaust valve rocker arm means adapted to disable said exhaust valve means from moving at the point it would move in the cycle during powering operation of the engine, trigger valve means hydraulically interconnected with said first and second piston means, said trigger valve means including trigger valve driving means driven by said exhaust valve pushtube means and spring means biasing said trigger valve driving means toward said exhaust valve pushtube means, said trigger valve means adapted to release the pressure on said first piston means at a pre-determined time so as to permit said exhaust valve means to partially close commencing prior to the bottom dead center position of said engine piston corresponding to its expansion stroke during powering operation, said latch member of said exhaust rocker arms means adapted to hold said exhaust valve in a partially closed position during at least the ensuing upstroke of said engine piston corresponding to its exhaust stroke during powering operation of the engine to produce a bleeder retarding event, said first piston means adapted to permit said exhaust valve to close fully during the ensuing downstroke of said engine piston corresponding to its intake stroke during powering operation of the engine whereby one compression release retarding event and one bleeder retarding event is produced in each said cylinder during each engine cycle comprising two revolutions of said crankshaft.

2. A rocker arm assembly for a four-stroke cycle internal combustion engine comprising a rocker member adapted to be mounted for oscillatory motion, an adjusting screw member adjustably threaded into said rocker member, at least one link member having first and second ends, said first end mounted coaxially with said rocker member, adjusting screw means adapted to adjustably limit the oscillation of said second end of said link member, a latch member having a face end and a hook end and pivotally mounted to said second end of said link member intermediate said hook end and said face end, a latch pin mounted in said rocker member for limited translational motion with respect to said rocker member, said latch pin adapted to engage said hook end of said latch member and first biasing means having first and second ends, said first end of said first biasing means adapted to engage said rocker member and said second end of said first biasing means adapted to engage said latch member intermediate said hook end of said latch member and said pivotal mounting of said latch member and said link member.

3. A rocker arm assembly as described in claim 2 in which said first biasing means is a compression spring.

4. A rocker arm assembly as described in claim 2 having a pair of link members and comprising, in addition, a pin member affixed at each end thereof to said second ends of said link members.

5. A rocker arm and trigger valve assembly for a four-stroke cycle internal combustion engine having a cylinder head, a housing affixed thereto and high and low pressure hydraulic circuits located in said housing comprising a rocker arm assembly adapted to be mounted on said cylinder head for oscillating motion with respect thereto, said rocker arm assembly including an adjusting screw member, a trigger valve body threaded into said housing and communicating between said high and low pressure hydraulic circuits, said trigger valve body having a passageway formed therethrough and a valve seat formed on one end thereof, a trigger valve adapted to seal against said valve seat, second biasing means biasing said trigger valve against said valve seat, a trigger driver mounted for reciprocating motion with respect to said trigger valve body, third biasing means adapted to bias said trigger driver away from said trigger body, trigger pin means having first and second ends mounted for reciprocating motion within said trigger valve body passageway and adapted to contact at said first end of said pin means said trigger driver and to contact said trigger valve at said second end of said trigger pin means.

6. A rocker arm and trigger valve assembly as described in claim 5 and comprising, in addition, stop means mounted on said housing adapted to limit the motion of said trigger driver in the direction in which it is biased by said third biasing means.

7. A rocker arm and trigger valve assembly as described in claim 5 in which said trigger pin means and said trigger driver are integral.

8. A rocker arm and trigger valve assembly as described in claim 5 in which said rocker arm assembly comprises a rocker member mounted on said cylinder head for oscillatory motion with respect thereto, an adjusting screw member adjustably threaded into said rocker member, at least one link member having first and second ends, said first end mounted coaxially with said rocker member, adjusting screw means threaded into said housing and adapted to adjustably limit the oscillation of said second end of said link member, a latch member having a face and a hook end and pivotally mounted to said second end of said link member intermediate said hook end and said face end, a latch pin mounted in said rocker member for limited translational motion with respect to said rocker member, said latch pin adapted to engage said hook end of said latch member and first biasing means having first and second ends, said first end of said first biasing means adapted to engage said rocker member and said second end of said first biasing means adapted to engage said latch member intermediate said hook end of said latch member and said pivotal mounting of said latch member and said link member.

9. A rocker arm and trigger valve assembly as described in claim 8 in which said first biasing means is a compression spring.

10. A rocker arm and trigger valve assembly as described in claim 8 having a pair of link members and comprising, in addition, a pin member affixed at each end thereof to said second ends of said link members.

11. A rocker arm and trigger valve assembly as described in claim 8 and comprising, in addition, stop means mounted on said housing and adapted to limit the motion of said trigger driver in the direction in which it is biased by said third biasing means.

12. A rocker arm and trigger valve assembly as described in claim 8 in which said trigger pin means and said trigger driver are integral.

13. A rocker arm assembly for a four-stroke cycle internal combustion engine comprising a rocker member adapted to be mounted for oscillatory motion, an adjusting screw member adjustably threaded into said rocker member, at least one link member having first and second ends, said first end pivotally mounted on said rocker member, adjusting screw means adapted to adjustably limit the oscillation of said second end of said link member with respect to said first end of said link member, a latch member having a face end and a hook end and pivotally mounted with respect to said second end of said link member and first biasing means adapted to bias said hook end of said latch member away from said rocker member.

14. A rocker arm assembly as described in claim 13 in which said first biasing means includes a compression spring.

15. A rocker arm assembly as described in claim 14 in which said first biasing means further includes a piston.

16. A rocker arm assembly as described in claim 13 wherein said rocker member is formed with an enlarged bore coaxial with said adjusting screw member and said adjusting screw member terminates within said bore.

17. A rocker arm and trigger valve assembly for a four-stroke cycle internal combustion engine having a cylinder head, a housing affixed thereto and high and low pressure hydraulic circuits located in said housing comprising a rocker arm assembly adapted to be mounted on said cylinder head for oscillating motion with respect thereto, said rocker arm assembly including an adjusting screw member, a trigger valve seat threaded into said housing and having a passageway formed therethrough which communicates between said high and low pressure hydraulic circuits, a trigger valve adapted to seal against said valve seat, second biasing means biasing said trigger valve against said valve seat a trigger valve actuating means mounted for reciprocating motion with respect to said valve seat, said biasing means mounted for reciprocating motion in said housing and located between said trigger valve means and said adjusting screw member.

18. A rocker arm and trigger valve assembly as described in claim 17 wherein said third biasing means comprises a telescoping piston assembly and a compression spring.

19. A rocker arm and trigger valve assembly as described in claim 17 wherein said rocker member is formed with an enlarged bore coaxial with said adjusting screw member and said adjusting screw terminates within said enlarged bore.

20. A rocker arm and trigger valve assembly as described in claim 17 in which said rocker arm assembly comprises a rocker member mounted on said cylinder head for oscillatory motion with respect thereto,, an adjusting screw member adjustably threaded into said rocker member, at least one link member having first and second ends, said first end pivotally mounted on said rocker member, adjusting screw means adapted to adjustably limit the oscillation of said second end of said link member with respect to said first en of said link member, a latch member having a face end and a hook end and pivotally mounted with respect to said second end of said link member and first biasing means adapted to bias said hook end of said latch member away from said rocker member.

21. A rocker arm and trigger valve assembly as described in claim 20 in which said first biasing means includes a compression spring.

22. A rocker arm and trigger valve assembly as described in claim 21 in which said first biasing means further includes a piston.

23. A rocker arm and trigger valve assembly as described in claim 20 wherein said rocker member is formed with an enlarged bore coaxial with said adjusting screw member and said adjusting screw member terminates within said enlarged bore.

24. An engine retarding system of a gas compression release type comprising a multi-cylinder four-stroke cycle internal combustion engine having a crankshaft and a camshaft driven from said crankshaft, engine piston means associated with said crankshaft, exhaust valve means, intake valve means and fuel injector means associated with each cylinder of said engine, rocker arm means associated with each of said exhaust valve means, in&take valve means and fuel injector means, pushtube means driven from said camshaft and associated with said exhaust valve means, intake valve means and fuel injector means, hydraulic fluid supply means, hydraulically actuated first piston means associated within said exhaust valve means to open said exhaust valve means, second piston means actuated by said pushtube means associated with said fuel injector means and hydraulically interconnected with said first piston means and said hydraulic fluid supply means to open said exhaust valve means during an upstroke o the engine piston associated with said exhaust valve means corresponding to its compression stroke during normal operation of the engine to produce a compression release event and to hold said exhaust valve means open during a substantial portion of the ensuing downstroke of said engine piston, said rocker arm means associated with said exhaust valves comprising a rocker member adapted to be oscillated by said exhaust valve pushtube, a latch member carried by said rocker member and adapted to drive said exhaust valve means, adjusting screw means adapted to limit the motion of said latch member and means biasing said latch member away from said rocker member, said exhaust valve rocker arm means adapted to disable said exhaust valve means from moving at the point it would move in the cycle during powering operation of the engine, trigger valve means hydraulically interconnected with said first and second piston means, said trigger valve means including trigger valve actuating means driven by said exhaust valve pushtube means and including spring means biasing said trigger valve driving means toward said exhaust valve pushtube means, said trigger valve means adapted to release the pressure on said first piston means at a predetermined time so as to permit said exhaust valve means to partially close commencing prior to the bottom dead center position of said engine piston corresponding to its expansion stroke during powering operation, said latch member of said exhaust rocker arm means adapted to hold said exhaust valve in a partially closed position during at least the ensuing upstroke of said engine piston corresponding to its exhaust stroke during powering opera&.ion of the engine to produce a bleeder retarding event, said first piston means adapted to permit said exhaust valve to close fully during the ensuing downstroke of said engine piston corresponding to its intake stroke during powering operation of the engine whereby one compression release retarding event and one bleeder retarding event is produced in each said cylinder during each engine cycle comprising two revolutions of said crankshaft.

25. A rocker arm assembly for a four-stroke cycle internal combustion engine comprising a rocker member having a lip portion adapted to be mounted for oscillatory motion, an adjusting screw member adjustably threaded into said rocker member, a latch member having a face end and a hook end carried by said rocker member and adapted to open an exhaust valve means; adjusting screw means adapted to limit the motion of said latch member and first biasing means carried by said rocker member and adapted to bias said hook end of said latch member away from said lip portion of said rocker member.

26. A rocker arm assembly as described in claim 25 in which said first biasing means includes a compression spring.

27. A rocker arm assembly as described in claim 26 in which said first biasing means further includes a piston.

28. A rocker arm assembly as described in claim 25 wherein said rocker member is formed with an enlarged bore coaxial with said adjusting screw member and said adjusting screw member terminates within said enlarged bore.

29. A rocker arm and trigger valve assembly as described in claim 17 in which said rocker arm assembly comprises a rocker member: having a lip portion adapted to be mounted for oscillatory motion on said cylinder head, an adjusting screw member adjustably threaded into said rocker member, a latch member having a face end and a hock end carried by said rocker member and adapted to open said exhaust valve means, adjusting screw means adapted to limit the motion of said latch member and first biasing means carried by said rocker member and adapted to bias said hook end of said latch member away from said lip portion of said rocker member.

30. A rocker arm and trigger valve assembly as described in claim 29 in which said first biasing means further includes a piston.

31. A rocker arm and trigger valve assembly as described in claim 29 wherein said rocker member is formed with an enlarged bore coaxial with said adjusting screw member and said adjusting screw member terminates within said enlarged bore.

* * * * *

UNITED STATES PATENT AND TRADEMARK OFFICE

CERTIFICATE OF CORRECTION

PATENT NO. : 4,793,307

DATED : December 27, 1988

INVENTOR(S) : Raymond N. Quenneville and Vincent J. Pitzi

It is certified that error appears in the above-identified patent and that said Letters Patent is hereby corrected as shown below:

| | |
|---|---|
| Col. 2, line 26 | "lowering" should be --powering-- |
| Col. 7, line 32 | "a" should be --an-- |
| Col. 7, line 58 | Delete "15" |
| Col. 10, line 19 | "an" should be --and-- |
| Col. 10, line 58 | "140a" should be --140b-- |
| Col. 12, line 41 | "mutt" should be --must-- |
| Col. 15, line 26 | After "said" insert --enlarged-- |
| Col. 15, line 41 | "said" should be --third-- |
| Col. 15, line 63 | "en" should be --end-- |
| Col. 16, line 20 | "in&take" should be --intake-- |
| Col. 16, line 24 | "within" should be --with-- |

UNITED STATES PATENT AND TRADEMARK OFFICE

CERTIFICATE OF CORRECTION

PATENT NO. : 4,793,307

DATED : December 27, 1988

INVENTOR(S) : Raymond N. Quenneville and Vincent J. Pitzi

It is certified that error appears in the above-identified patent and that said Letters Patent is hereby corrected as shown below:

Col. 16, line 30 "o" should be --of--

Col. 16, line 62 "opera&.ion" should be --operation--

Col. 18, line 9 "hock" should be --hook--

Signed and Sealed this

Twenty-fourth Day of July, 1990

*Attest:*

HARRY F. MANBECK, JR.

*Attesting Officer*

*Commissioner of Patents and Trademarks*